US005207080A

United States Patent [19]

Reinhard

[11] Patent Number: 5,207,080

[45] Date of Patent: May 4, 1993

[54] AUTOMATIC DISPENSING APPARATUS

[75] Inventor: Roger A. Reinhard, Greensboro, N.C.

[73] Assignee: Kay Chemical Company, Greensboro, N.C.

[21] Appl. No.: 836,831

[22] Filed: Feb. 19, 1992

[51] Int. Cl.[5] ..... D06F 39/02

[52] U.S. Cl. ..... 68/12.18; 68/17 R; 222/52

[58] Field of Search ..... 68/12.18, 17 R; 134/93, 134/99.2; 222/52, 63

[56] References Cited

U.S. PATENT DOCUMENTS 3,223,285 12/1965 Anderson .
3,653,234 4/1972 Gillespie .
3,826,408 7/1974 Berndt et al. .
3,881,328 5/1975 Kleimola et al. ..... 68/12.18
3,947,788 3/1976 Berry .

FOREIGN PATENT DOCUMENTS 3054194 3/1988 Japan ..... 68/17 R X

*Primary Examiner*—Philip R. Coe
*Attorney, Agent, or Firm*—Finnegan, Henderson, Farabow, Garrett & Dunner

[57] ABSTRACT

A dispensing apparatus for automatically dispensing detergent into a laundry machine. The electrical current drawn by the laundry machine is monitored by a detecting device to detect when the electrical current exceeds a predetermined threshold current. When the electrical current exceeds the threshold current, the detecting device transmits a signal indicating that detergent should be conveyed from the detergent supply to the washtub of the laundry machine by a conveying device. The signal is delayed for a predetermined period of time by a delay timer. After the delay, the conveying device is controlled to convey the detergent. If the washing process is interrupted for less than a predetermined period of time, a dwell timer prevents multiple conveyance of detergent into the washtub.

30 Claims, 4 Drawing Sheets

AUTOMATIC DISPENSING APPARATUS

BACKGROUND OF THE INVENTION

1. Field of the Invention

The present invention relates to an apparatus for automatically dispensing an additive into a machine, and more particularly to an apparatus for automatically dispensing detergent into a laundry machine.

2. Description of the Related Art

Laundry machines typically utilize a washing process that includes a wash cycle, a rinse cycle, and a spin cycle. During the wash cycle, water is automatically injected into the washtub of the laundry machine to wet the laundry, detergent is added into the washtub, and the washtub is agitated to wash the laundry. During the rinse cycle, water is injected into the washtub to remove residual detergent from the laundry. During the spin cycle, the washtub is rotated at a high speed to remove water from the laundry. To operate properly, laundry machines require that a proper amount of detergent be added into the washtub of the laundry machine at a proper time during the wash cycle. The detergent is usually added manually by the operator of the laundry machine.

There are many drawbacks associated with dispensing detergent manually. For example, manual dispensing requires the attention of the operator during the wash cycle and, therefore, is inconvenient and time consuming. Also, manual dispensing of the detergent creates an opportunity for operator error, such as neglecting to dispense detergent or dispensing too much detergent, which would adversely affect the performance of the laundry machine.

There are operator activated systems for laundry machines that automatically dispense detergent. Such systems include devices having a timing mechanism that is external to the laundry machine. The timing mechanism is synchronized with the washing process of the laundry machine and indicates when detergent should be dispensed into the washtub. The timing process begins when the timing mechanism is activated manually by the operator of the laundry machine.

Problems exist with an external non-synchronized timing system. For example, if the operator does not activate the timing mechanism at the proper time, the timing of the dispensing system will not be synchronized with the timing of the laundry machine. Also, since the timing mechanism is not directly connected to the controller of the laundry machine, the timing mechanism may not be properly synchronized with the laundry machine.

Another known type of detergent dispensing system is directly connected to the controller or timing mechanism that controls the operation of the laundry machine. In this type of system, the controller or timing mechanism indicates when detergent should be dispensed into the washtub. Yet another known type of detergent dispensing system is connected directly to the internal electrical circuitry of the laundry machine and determines therefrom the proper time to dispense detergent into the washtub.

These systems are, however, not fully satisfactory. Dispensing systems that require connections to the inner mechanisms or inner circuitry of the laundry machine require that installation of the dispensing system be performed by someone with a working knowledge of mechanical and electrical devices. The connection process also requires disassembly of the laundry machine, thereby requiring a relatively large amount of time and effort to install the dispensing system.

SUMMARY OF THE INVENTION

An object of the present invention is to provide an apparatus for automatically dispensing detergent into a laundry machine.

Another object of the present invention is to provide an automatic dispensing apparatus that can be quickly and easily connected to and used in conjunction with a laundry machine.

Another object of the present invention is to provide an automatic dispensing apparatus that does not require connections to the internal circuitry or timing mechanism of the laundry machine.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an apparatus for dispensing an additive into a machine having an external power line that is to be connected to an external power source to power the machine. The dispensing apparatus comprises means for conveying the additive from an additive supply to the machine. Means are provided for monitoring the external power line to detect when a predetermined amount of electrical current is drawn by the machine to power the machine and for transmitting a signal, in response to the detection of the predetermined amount of electrical current, indicating that the conveying means should commence conveyance of the additive.

In another aspect of the present invention, an apparatus is provided for dispensing an additive into a machine having a housing and an external power line that extends outside the housing and that is to be connected to an external power source to power the machine. The dispensing apparatus comprises means for conveying the additive from an additive supply to the machine. A receptacle is provided for receiving the external power line of the machine. The apparatus comprises a dispensing apparatus power line for connection to the external power source, the dispensing apparatus power line providing electrical current to both the dispensing apparatus and the machine when the power line of the machine is connected to the receptacle and the dispensing apparatus power line is connected to the power source. Means are provided for detecting when a predetermined amount of electrical current is drawn by the machine to power the machine and for transmitting a signal, in response to the detection of the predetermined amount of electrical current, indicating that the conveying means should commence conveyance of the additive.

In yet another aspect of the present invention, an apparatus is provided for automatically dispensing an additive into a machine. The apparatus comprises means for conveying the additive from an additive supply to the machine. Means are provided for detecting when a predetermined amount of electrical current is drawn by the machine to power the machine and for transmitting a signal, in response to the detection of the predetermined amount of electrical current, indicating that the conveying means should commence conveyance of the additive. The apparatus comprises means for delaying commencement of the conveyance of the additive. Means are provided for controlling the amount of additive that is conveyed by the conveying means from the additive supply to the machine. The apparatus also comprises means for preventing multiple conveyance of the additive from the additive supply to the machine after a decrease in electrical power drawn by the machine for less than a predetermined period of time.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate a preferred embodiment of the invention and together with the general description provided above and the detailed description provided below, serve to explain the principles of the invention.

DESCRIPTION OF THE PREFERRED EMBODIMENT

Reference will now be made in detail to the present preferred embodiment of the invention that is illustrated in the accompanying drawings. Wherever possible, the same reference numbers will be used throughout the drawings to refer to the same or like parts.

Figure 1:
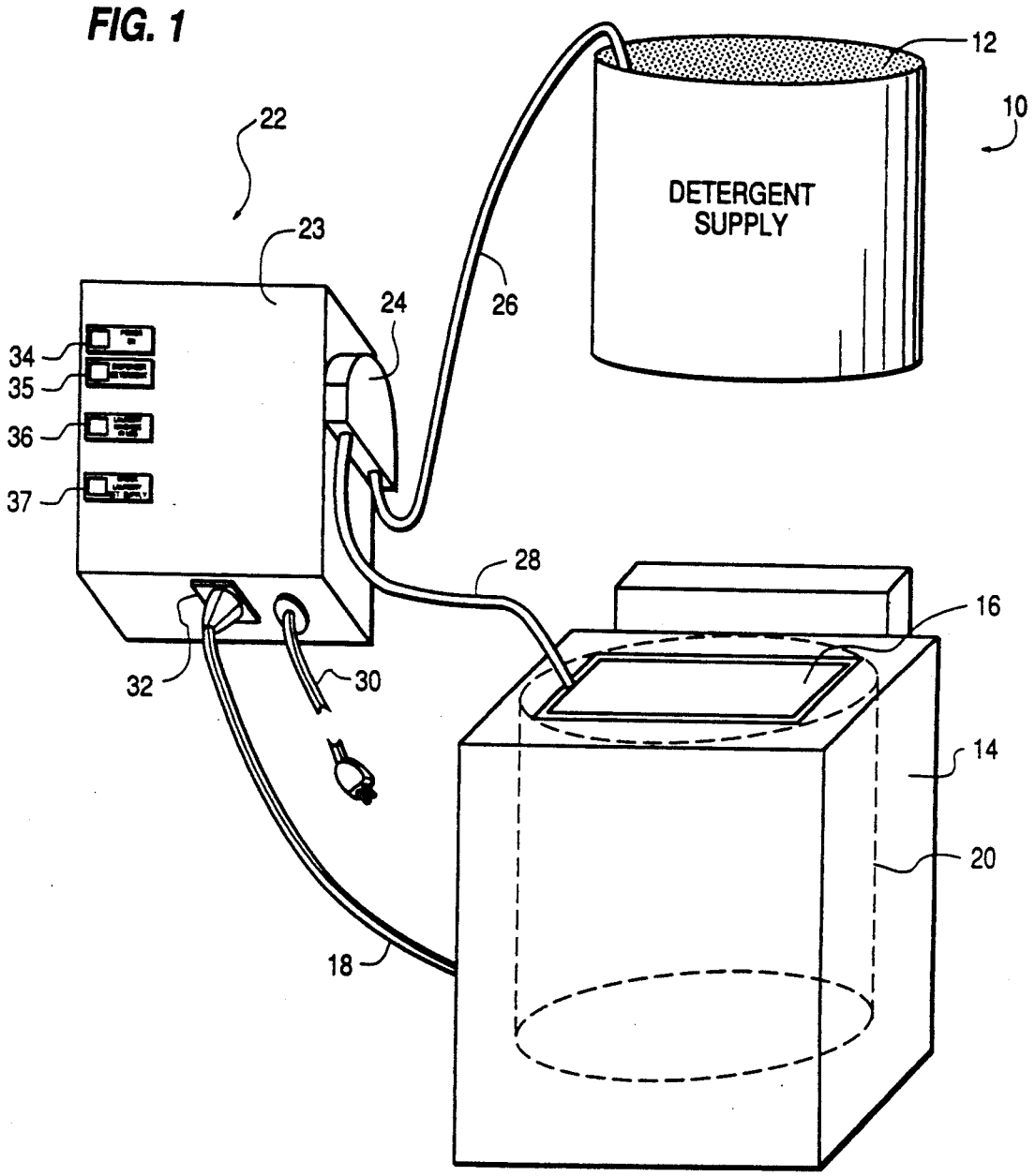
FIG. 1 is a perspective view illustrating the preferred embodiment of the present invention and the connections between the apparatus of the present invention and a detergent supply and a laundry machine.

In accordance with the present invention, an apparatus is provided for dispensing an additive into a machine. The apparatus includes means for conveying the additive from an additive supply to the machine, means for detecting when a predetermined amount of electrical current is drawn by the machine to power the machine and for transmitting a signal, in response to the detection of the predetermined amount of electrical current, indicating that the conveying means should commence conveyance of the additive, means for delaying commencement of the conveyance of the additive, means for controlling the amount of additive that is conveyed by the conveying means from the additive supply to the machine, and means for preventing multiple conveyance of the additive from the additive supply to the machine after a decrease in electrical power drawn by the machine for less than a predetermined period of time. As embodied herein and as shown in FIG. 1, a dispensing apparatus indicated generally by the reference numeral 22 conveys detergent 12 from a detergent supply 10 to a washtub 20 of a laundry machine 14. The detergent 12 can be in any form, including, for example, powder, tablet, or liquid. The detergent supply can be external to dispensing apparatus 12 as depicted in FIG. 1 or can be disposed within the enclosure 23.

A description of the dispensing apparatus 22 of the present invention will now be provided with reference to the laundry machine 14. Preferably, the apparatus of the present invention is housed in an enclosure 23. As shown in FIG. 1, a power line receptacle 32 is mounted on the enclosure 23 and a dispensing apparatus external power line 30 extends from the enclosure 23. Various indicator lights are provided on the enclosure 23. In the preferred embodiment, the indicators are light emitting diodes 34 (also designated by "DS1" in FIG. 3), 35 (also designated by "DS4" in FIG. 3), 36 (also designated by "DS3" in FIG. 3), and 37 (not shown in FIG. 3) that indicate whether the power to the dispensing apparatus is on, the apparatus is dispensing detergent 12, the laundry machine 14 is in use, and if the detergent supply 10 should be checked, respectively.

In the preferred embodiment, the apparatus of the present invention is installed by placing a pickup tube 26 into a detergent supply 10 and inserting a discharge tube 28 into the washtub 20 of the laundry machine 14. Installation is further accomplished by unplugging the laundry machine external power line 18 from its existing connection with the receptacle of an external power supply (not shown) and plugging the laundry machine external power line 18 into the receptacle 32 in the dispensing apparatus 22. The dispensing apparatus external power line 30 is then plugged into the receptacle of the external power supply, which was previously occupied by the laundry machine external power line 18. Dispensing apparatus 22 is mounted in any conventional manner adjacent to laundry machine 14.

In accordance with the present invention, the apparatus includes means for conveying the additive from an additive supply to the machine. As embodied herein, conveying means 40 includes a pump 24 that draws detergent 12 from the detergent supply 10 through a pickup tube 26 and supplies the detergent 12 to the washtub 20 through a discharge tube 28. A peristaltic pump is preferred because a peristaltic pump exhibits positive displacement characteristics when pumping into an open reservoir and, therefore, the quantity of detergent 12 conveyed by the pump 24 can be accurately controlled by controlling the time during which the pump 24 is active. The pump 24 need not, however, be peristaltic. The pump 24 can, for example, be a diaphragm, piston, or gear pump. The conveying means 40 could also, for example, include a venturi device. The conveying means could also include a tablet dispenser on an auger type feeder if the additive is in tablet or powdered form.

In accordance with the present invention, means are provided for detecting when a predetermined amount of electrical current is drawn by the machine to power the machine and for transmitting a signal, in response to the detection of the predetermined amount of electrical current, indicating that the conveying means 40 should commence conveyance of the additive. The detecting means 42 is powered by electrical current supplied through the external power line 30 that is connected to an external power source. In the preferred embodiment, the laundry machine 14 is also powered by the electrical current supplied through the external power line 30. The external power line 18 of the laundry machine 14 is connected to the receptacle 32 on the dispensing apparatus 22, which is connected to the detecting means 42. The detecting means 42 can, therefore, monitor the amount of current provided to the laundry machine 14 to detect whether the current drawn by the laundry machine 14 rises above the predetermined threshold current. If the actual current rises above the threshold current, the detecting means 42 transmits a signal indicating that the dispensing of the additive should be commenced. The signal is transmitted through multiple conveyance preventing means 64 and through delaying means 50 to additive amount controlling means 58, which controls the amount of additive conveyed by the conveying means 40.

As embodied herein, the detecting means 42 detects when a predetermined amount of electrical current is drawn by the laundry machine 14 by comparing the voltage across resistors 43 and 44 (also designated by "R9A" and "R9B" in FIG. 3), which are parallel to each other and in series with the power line 18, with a predetermined threshold voltage. The comparison is performed by a dual comparator 46 (also designated by "U1" in FIG. 3).

The predetermined threshold voltage is proportional to the predetermined threshold current. When the voltage drop across resistors 43 and 44 is equal to or greater than the predetermined threshold voltage drop, this indicates that the current drawn by the laundry machine 14 is above the predetermined threshold current. The threshold current can be changed by adjusting potentiometer 48 (also designated by "R10" in FIG. 3).

The predetermined threshold current should preferably be set at a current slightly below the current drawn by the laundry machine when it starts the washing process. By setting the threshold current at such a level, the dispensing apparatus 22 will not be activated by leakage of voltage across resistors 43 and 44, which may be caused, for example, by indicator lights on the laundry machine 14. If the threshold current is set at a sufficiently high level, the dispensing apparatus 22 will only be activated when the laundry machine 14 begins the washing process.

The preferred embodiment detects the current drawn by the laundry machine 14 by monitoring the current drawn through external power line 18 of the laundry machine 14. The detecting means 42 does not have to be directly connected to the external power line 18 of the laundry machine 14. The detecting means 42 could, for example, be a coil that measures the magnetic field around the external power line 18. Such a coil is referred to as a current sensing transformer. The magnetic field around the power line 18 increases as the current passing through the power line 18 increases and, therefore, a current increase can be detected by sensing the magnetic field around the external power line 18.

In accordance with the present invention, the apparatus includes means for delaying commencement of the conveyance of the additive, which means further includes means for delaying transmission of the signal transmitted by the detecting means 42 for a predetermined period of time. As embodied herein, the delaying means 50 includes a programmable delay timer 52 (also designated as "U4" in FIG. 3). The delay timer 52 delays the commencement of conveying the detergent 12 into the laundry machine 14 for predetermined period of time by delaying the transmittal of the signal, which was received from the detecting means 42, to the additive amount controlling means 58. The delay caused by the delay timer 52 can be fixed or adjustable. In the preferred embodiment, the length of the delay is set by potentiometer 54 (also designated by "R31" in FIG. 3). A presently preferred delay is 1 to 1½ minutes. In the preferred embodiment, a light emitting diode 56 (also designated by "DS2" in FIG. 3) indicates when the delay has ended.

There are numerous advantages achieved by delaying commencement of dispensing of the additive after the wash cycle has begun. For example, the delay can allow the water, which is automatically injected into the washtub 20, to wet the laundry prior to the injection of the detergent 12 onto the laundry. Additionally, for example, the delay allows the operator of the laundry machine 14 to change his or her mind as to whether to continue either the wash process or the selected fabric cycle.

In accordance with the present invention, the apparatus includes means for controlling the amount of additive that is conveyed by the conveying means 40 from the additive supply to the machine, which means further includes means for controlling the length of time that the conveying means 40 is activated. As embodied herein, the controlling means 58 includes an programmable feed timer 60 (also designated by "U5" in FIG. 3). The feed time can be fixed or can be adjustable. In the preferred embodiment the detergent feed time is set by potentiometer 62 (also designated by "R37" in FIG. 3). The detergent feed timer 60 is calibrated to activate the conveying means 40 for an amount of time required to inject the predetermined, correct amount of detergent 12 into the laundry machine 14. In the preferred embodiment, a light emitting diode 35 (also designated by "DS4" in FIG. 3) indicates when the conveying means 40 is activated.

In accordance with the present invention, the apparatus includes means for preventing multiple conveyance of the additive from the additive supply to the machine after a decrease in electrical power drawn by the machine for less than a predetermined period of time, which means further includes means for timing the predetermined period of time. As embodied herein, the preventing means 64 includes a programmable dwell compensation timer 66 (also designated by "U3" in FIG. 3) that is known in the art as a delay on break timer. In the preferred embodiment, the predetermined period of time is set by a potentiometer 68 (also designated by "R20" in FIG. 3). When the current drops below the threshold amount and relay K1 (FIG. 3B) opens, the timing mechanism of dwell compensation timer 66 is engaged. While timer 66 is engaged, the remainder of the circuit does not recognize that relay K1 is open. When the predetermined period of time has elapsed, K1 will be re-energized if the dwell period is over. If K1 is not re-energized, the dispensing cycle ends.

Some laundry machines, after an operation, may dwell for a period of time prior to beginning the next operation. For example, a laundry machine 14, after the washtub 20 is filled with water, may dwell for 3–45 seconds before beginning agitation. Also, the laundry machine 14 may dwell between cycles, for example, between wash and rinse cycles. Some machines cease agitation when the lid 16 is lifted. Thus, a dwell occurs if the operator lifts the lid 16 of such a laundry machine 14 after the machine has begun the washing process. In the above examples, the dwell is designed into circuitry of the laundry machine 14 and cannot be readily changed by an individual installing an automatic dispensing apparatus 22.

If dwell occurs, current drawn by the machine is reduced or eliminated during the dwell period. Without compensating for dwell, the dispensing apparatus 22 would interpret the lack of a current as the end of the washing process and would go into a stand-by mode and await the beginning of the next washing process. When the dwell ended, the current drawn by the laundry machine 14 would increase the current in the power line 18 above the predetermined threshold current and the dispensing apparatus 22 would interpret the increase in current as the beginning of a new washing process. The detecting means 42 would then transmit a signal indicating that the dispensing apparatus 22 should convey detergent 12 to dispense second portion of detergent 12 into the laundry machine 14. The second dispensing of detergent 12 is not desirable because it wastes detergent 12 and can affect the quality of the washing process. The dwell timer 66 prevents the detergent 12 from being dispensed more than once during a single washing process by maintaining the circuit through breaks in the continuity of the wash process that do not last for more than a predetermined period of time.

The dispensing apparatus 22 operates in the following manner. When the laundry machine 14 is activated, the detecting means 42 monitors the current drawn by the laundry machine 14 to detect whether the current increases above a predetermined threshold current. When the current rises above the threshold current, the detecting means 42 transmits a signal to the delay timer 52 through the non-engaged dwell timer 66. After the delay caused by the delay timer 52, the feed timer 60 is activated and it activates the pump 24 to convey detergent 12 for a predetermined period. If the washing process is interrupted for less than a predetermined period of time, the dwell timer 66 is energized and prevents a second conveyance of detergent 12 into the washtub 20 upon the restart of the laundry machine 14.

Figure 2:
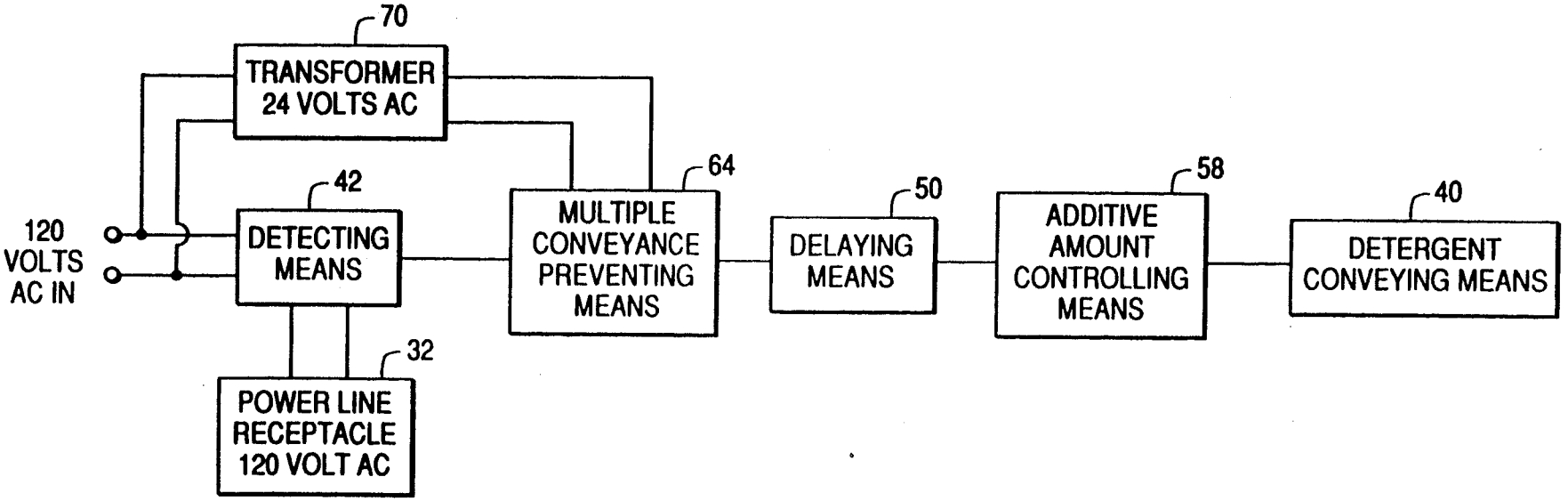
FIG. 2 is a block diagram illustrating the major components of the preferred embodiment of the present invention and their relationship.
Figure 3A:
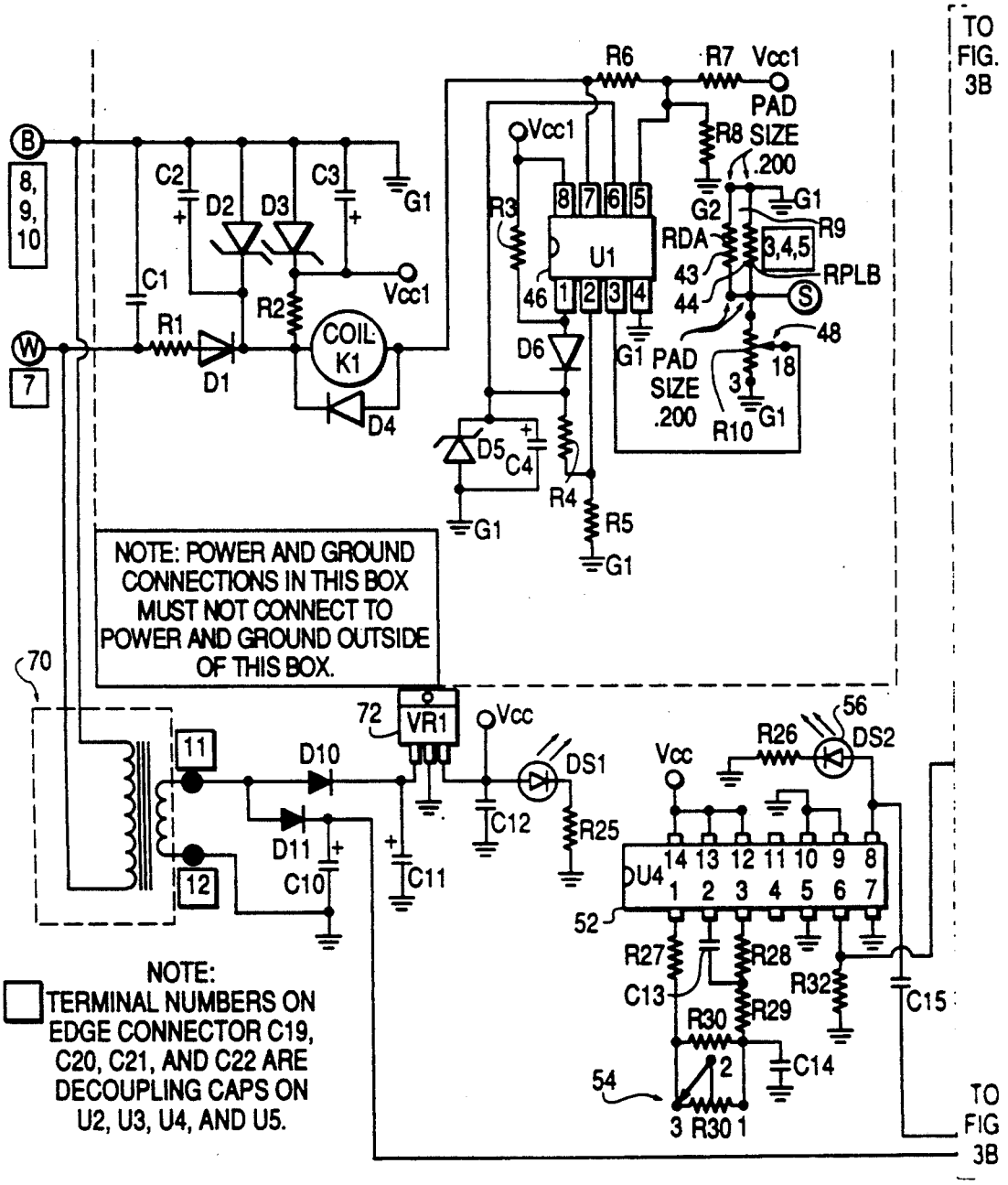
FIGS. 3A and 3B constitute an electrical schematic diagram of the control circuit of the preferred embodiment of the present invention.
Figure 3B:
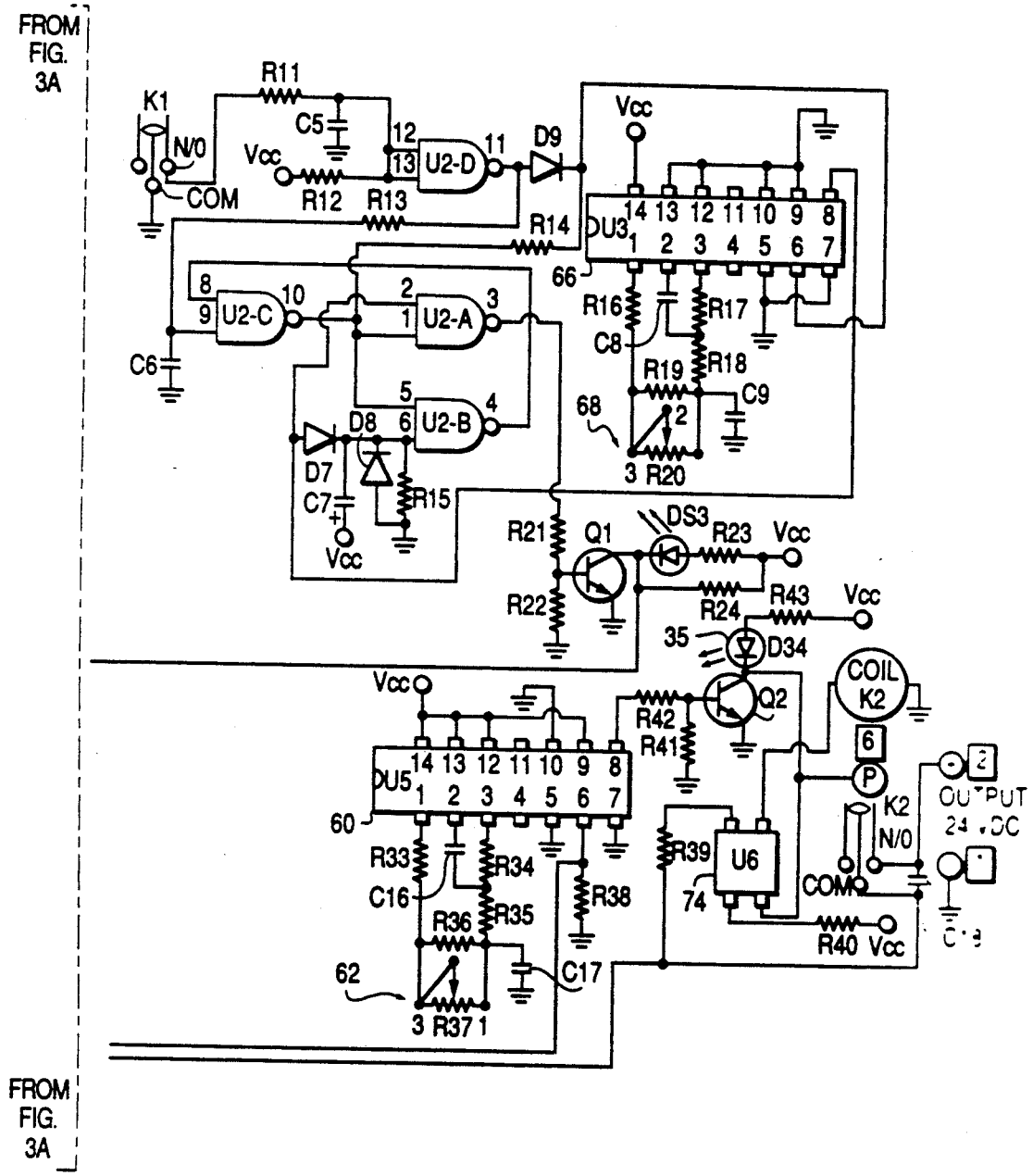

The block diagram of FIG. 2 and the electrical schematic diagram of FIG. 3 have been included to provide a more detailed understanding of the preferred embodiment of the apparatus of the present invention. The flowchart and diagram show in detail a preferred embodiment and are readily understandable to one of ordinary skill in the art. The preferred embodiment shown in FIG. 3 includes a 24 volt step down transformer 70, a 12 volt, 1.5 amp voltage regulator 72 (also designated by "VR1" in FIG. 3), and an optoisolator 74 (also designated by "U60" in FIG. 3).

The dispensing apparatus of the present invention is fully automatic and, once installed, dispenses detergent without requiring supervision by the operator of the laundry machine. The apparatus of the present invention accurately controls the amount of detergent fed into the washtub.

The dispensing apparatus of the present invention is easy to install, requiring only a connection to the external power line of the laundry machine and the insertion of the intake and discharge tubes into the detergent supply and washtub, respectively. Therefore, the apparatus of the present invention can be installed by someone without any significant knowledge of mechanical or electrical devices. The dispensing apparatus also eliminates the need for disassembly of the laundry machine, thereby greatly reducing the time and effort required for installation of the apparatus.

It will be apparent to those skilled in the art that various modifications and variations can be made in the dispensing apparatus of the present invention and in construction of this apparatus without departing from the scope or spirit of the invention. For example, the discharge tube 28 has been disclosed as extending under the lid 16 of the laundry machine 14 and into the washtub 20. The discharge tube 28 could also be positioned in a hole in the lid 16 by means of a bulkhead fitting.

Furthermore, the preferred embodiment has been disclosed as an apparatus for dispensing detergent 12 into a laundry machine 14. The apparatus of the present invention could, however, be used to dispense most any type of additive into a variety of machines. It is contemplated that multiple dispensing apparatus can be used to dispense multiple additives into the same machine. For example, two apparatus can be used in connection with a laundry machine, with one apparatus dispensing bleach and the other apparatus dispensing detergent. It is also contemplated that the multiple dispensing apparatus could be housed within the same enclosure and share common elements such as the detecting means.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An apparatus for automatically dispensing an additive into a machine, comprising:

means for conveying the additive to the machine;

means for detecting when a predetermined amount of electrical current is drawn by the machine and for transmitting a signal, in response to the detection of the predetermined amount of electrical current, indicating that the conveying means should commence conveyance of the additive;

means for delaying commencement of the conveyance of the additive; and means for controlling the amount of additive that is conveyed by the conveying means to the machine.

2. The apparatus of claim 1, wherein the means for conveying the additive to the machine includes a pump.

3. The apparatus of claim 2, wherein the pump is a peristaltic pump.

4. The apparatus of claim 1, wherein the detecting means detects electrical current drawn by the machine from a power source external to the machine.

5. The apparatus of claim 4, wherein the electrical current drawn by the machine passes through the detecting means.

6. The apparatus of claim 1, wherein the means for delaying commencement of the conveyance of the additive includes means for delaying transmission of the signal transmitted by the detecting means for a predetermined period of time.

7. The apparatus of claim 6, wherein the predetermined period of time is determined by a timer.

8. The apparatus of claim 7, wherein the timer is adjustable.

9. The apparatus of claim 1, wherein the means for controlling the amount of additive that is conveyed by the conveying means from the additive supply to the machine includes means for controlling the length of time that the conveying means is activated.

10. The apparatus of claim 9, wherein the means for controlling the length of time that the conveying means is activated includes a timer.

11. The apparatus of claim 10, wherein the timer is adjustable.

12. The apparatus of claim 1, further comprising means for preventing multiple conveyance of the additive to the machine after a decrease in electrical power drawn by the machine for less than a predetermined period of time.

13. The apparatus of claim 12, wherein the means for preventing multiple conveyance of the additive includes means for timing the predetermined period of time.

14. The apparatus of claim 13, wherein the means for timing the predetermined period of time is adjustable.

15. The apparatus of claim 1, wherein the machine is a laundry machine.

16. The apparatus of claim 15, wherein the additive is laundry detergent.

17. An apparatus for dispensing an additive into a machine having an external power line that is to be connected to an external power source to power the machine, the dispensing apparatus comprising:

means for conveying the additive to the machine; and means for monitoring the external power line to detect when a predetermined amount of electrical current is drawn by the machine and for transmitting a signal, in response to the detection of the predetermined amount of electrical current, indicating that the conveying means should commence conveyance of the additive.

18. The apparatus of claim 17, wherein the machine is a laundry machine.

19. The apparatus of claim 18, wherein the additive is laundry detergent.

20. The apparatus of claim 17, further comprising means for delaying commencement of the conveyance of the additive.

21. The apparatus of claim 17, further comprising means for preventing multiple conveyance of the additive after a decrease in electrical power drawn by the machine for less than a predetermined period of time.

22. An apparatus for dispensing an additive into a machine having a housing and an external power line that extends outside the housing and that is to be connected to an external power source to power the machine, the dispensing apparatus comprising:

means for conveying the additive to the machine;

a receptacle for receiving the external power line of the machine;

a dispensing apparatus power line for connection to the external power source, the dispensing apparatus power line providing electrical current to both the dispensing apparatus and the machine when the power line of the machine is connected to the receptacle and the dispensing apparatus power line is connected to the power source; and means for detecting when a predetermined amount of electrical current is drawn by the machine and for transmitting a signal, in response to the detection of the predetermined amount of electrical current, indicating that the conveying means should commence conveyance of the additive.

23. The apparatus of claim 22, wherein the machine is a laundry machine.

24. The apparatus of claim 22, wherein the additive is laundry detergent.

25. The apparatus of claim 22, further comprising means for delaying commencement of the conveyance of the additive.

26. The apparatus of claim 22, further comprising means for preventing multiple conveyance of the additive after a decrease in electrical power drawn by the machine for less than a predetermined period of time.

27. A system for dispensing detergent into a laundry machine, the laundry machine including an external power line, the system comprising:

an enclosure, the enclosure having a receptacle for receiving the external power line of the laundry machine;

a power line for connection to an external power source;

means for conveying the detergent to the laundry machine;

means for detecting when a predetermined amount of electrical current is drawn by the machine and for transmitting a signal, in response to the detection of the predetermined amount of electrical current, indicating that the conveying means should commence conveyance of the detergent;

means for delaying commencement of the conveyance of the detergent; and means for controlling the amount of detergent that is conveyed to the laundry machine.

28. The system of claim 27, wherein the conveying means includes a peristaltic pump.

29. The system of claim 27, further comprising means for preventing multiple conveyance of detergent to the laundry machine after a decrease in electrical power drawn by the machine for less than a predetermined period of time.

30. The system of claim 27, wherein the delaying means includes means for delaying transmission of the signal transmitted by the detecting means for a predetermined period of time.

* * * * *